US010179681B2

(12) United States Patent
Timm et al.

(10) Patent No.: US 10,179,681 B2
(45) Date of Patent: Jan. 15, 2019

(54) CASE FOR ACCOMMODATING TOOLS OR SMALL ITEMS

(71) Applicant: Adolf Würth GmbH & Co. KG, Künzelsau (DE)

(72) Inventors: Felix Timm, Dornstadt (DE); Johannes Starke, Ellhofen (DE); Daniel Kraus, Niederstotzingen (DE); Simon Koch, Dörzbach (DE); Wolfgang Hohl, Künzelsau (DE)

(73) Assignee: Adolf Würth GmbH & Co. KG, Künzelsau (DE)

( * ) Notice: Subject to any disclaimer, the term of this patent is extended or adjusted under 35 U.S.C. 154(b) by 0 days.

(21) Appl. No.: 15/532,842

(22) PCT Filed: Dec. 7, 2015

(86) PCT No.: PCT/EP2015/078856
§ 371 (c)(1),
(2) Date: Jun. 2, 2017

(87) PCT Pub. No.: WO2016/091821
PCT Pub. Date: Jun. 16, 2016

(65) Prior Publication Data

US 2017/0362002 A1 Dec. 21, 2017

(30) Foreign Application Priority Data

Dec. 11, 2014 (DE) ..... 10 2014 225 510

(51) Int. Cl.
*B25H 3/02* (2006.01)
*B65D 53/00* (2006.01)
*B65D 43/16* (2006.01)
*A45C 13/00* (2006.01)
*A45C 5/03* (2006.01)

(52) U.S. Cl.
CPC ..... *B65D 53/00* (2013.01); *B25H 3/02* (2013.01); *B65D 43/163* (2013.01); *A45C 13/008* (2013.01); *A45C 2005/037* (2013.01)

(58) Field of Classification Search
USPC ..... 206/372, 373, 349; 220/783, 795
See application file for complete search history.

(56) References Cited

U.S. PATENT DOCUMENTS 3,856,178 A * 12/1974 Norgaard ..... B65D 21/0213 206/499
3,949,872 A * 4/1976 Paudras ..... G11B 33/0427 206/310

(Continued)

FOREIGN PATENT DOCUMENTS

DE 82 26 615 U1 12/1982
DE 195 12 301 A1 10/1996

(Continued)

*Primary Examiner* — Jacob K Ackun
(74) *Attorney, Agent, or Firm* — Boyle Fredrickson, S.C.

(57) ABSTRACT

A case for holding tools or small parts includes a basic body and a lid coupled pivotably to the basic body. The basic body has two side walls, the upper edge of which is exposed in the closed state of the lid, and therefore the lid, in the closed state, is arranged between the upper edges of the side walls of the basic body. Each side wall of the basic body forms a labyrinth seal with the respective side wall of the lid in the closed state of the case.

7 Claims, 5 Drawing Sheets

(56) References Cited

U.S. PATENT DOCUMENTS

Figure 1:
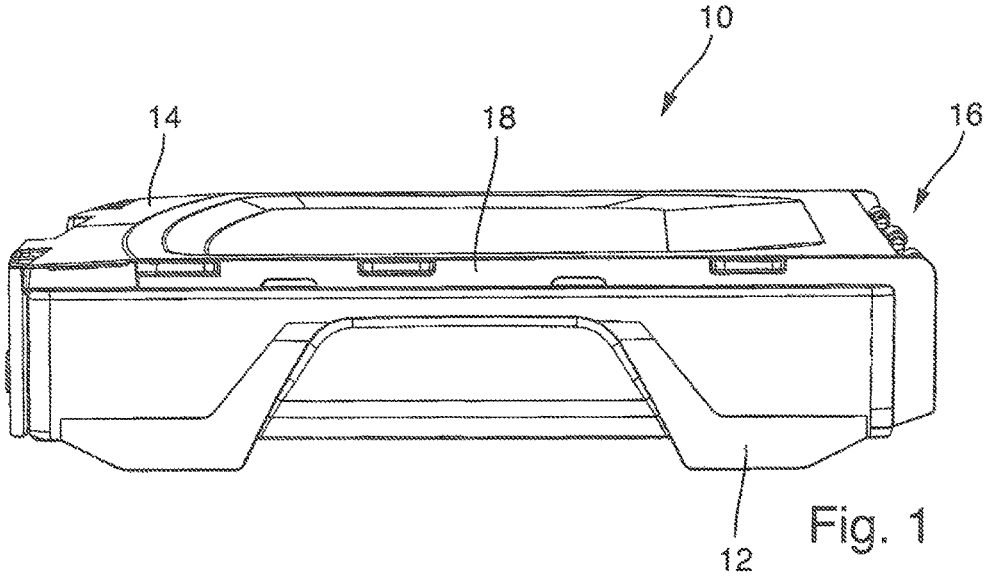

| | | | | | |
|---|---|---|---|---|---|
| 3,987,829 | A * | 10/1976 | Leone | B65D 1/22 | 220/675 |
| 4,654,470 | A * | 3/1987 | Feldman | H01R 4/2483 | 174/50 |
| 4,972,527 | A | 11/1990 | Wallace | | |
| 5,074,428 | A * | 12/1991 | Wildfeuer | B65D 43/0218 | 220/322 |
| 5,425,453 | A * | 6/1995 | Dirx | G03C 3/00 | 206/455 |
| 5,934,466 | A * | 8/1999 | Loeffler | A47B 87/0269 | 206/372 |
| 7,472,730 | B2 | 1/2009 | Adkins | | |
| 8,434,617 | B1 * | 5/2013 | Wang | B25H 3/02 | 206/372 |
| 8,677,661 | B2 | 3/2014 | Michels et al. | | |
| 9,381,639 | B2 | 7/2016 | Werner et al. | | |
| 2002/0117414 | A1 * | 8/2002 | Kipper | B25H 3/023 | 206/373 |
| 2009/0120835 | A1 * | 5/2009 | Ublacker | B65D 7/06 | 206/774 |
| 2012/0312708 | A1 * | 12/2012 | Roehm | B25H 3/021 | 206/349 |
| 2014/0102928 | A1 * | 4/2014 | Sabbag | B25H 3/028 | 206/372 |
| 2014/0166516 | A1 * | 6/2014 | Martinez | B25H 3/022 | 206/372 |
| 2016/0075479 | A1 | 3/2016 | Finke et al. | | |

FOREIGN PATENT DOCUMENTS

| | | |
|---|---|---|
| GB | 2 302 323 B | 1/1997 |
| GB | 2 437 513 A | 10/2007 |

* cited by examiner

CASE FOR ACCOMMODATING TOOLS OR SMALL ITEMS

The invention relates to a case for holding tools or small parts, comprising a basic body and a lid coupled pivotably to the basic body, wherein the basic body has two side walls, the upper edge of which is exposed in the closed state of the lid, and therefore the lid, in the closed state, is arranged between the upper edges of the side walls of the basic body.

With the invention, a lid is intended to be improved in respect, of the sealing thereof against dirt, moisture and water.

For this purpose, according to the invention, a case having the features of Claim 1 is provided. Advantageous developments of the invention are specified in the dependent claims.

In the case of a case for holding tools or small parts, comprising a basic body and a lid coupled pivotably to the basic body, wherein the basic body has two side walls, the upper edge of which is exposed in the closed state of the lid, and therefore the lid, in the closed state, is arranged between the upper edges of the side walls of the basic body, it is provided that each side wall of the basic body forms a labyrinth seal with the respective side wall of the lid in the closed state of the case.

By providing a labyrinth seal at least in the side walls of the lid, it is possible for a seal which is reliable and at the same time can be produced in a simple manner to be realized. Both the lid and the basic body of the case are expediently designed as injection-moulded plastics parts. The realization of a labyrinth seal is then easily possible. The provision of a labyrinth seal has the advantage that a sealing effect can be achieved even without additional elastic seals. The sealing effect is therefore independent of the precise placing of a seal and independent of the elasticity thereof. This is of great advantage specifically in the case of cases for tools or small parts for harsh construction site operation since elastic seals are subject to an ageing process and may also be damaged comparatively rapidly and easily due to insolation, heat or mechanical action.

In a development of the invention, a rear wall of the lid together with a rear wall of the basic body, and a front wall of the lid together with a front wall of the basic body, in each case form a labyrinth seal, and therefore the labyrinth seal completely encircles an opening of the case, which opening is closed by means of the lid.

By means of an encircling labyrinth seal, the case can be particularly reliably sealed against penetration of dirt, moisture and water.

In a development of the invention, the labyrinth seal is formed by means of recess which is U-shaped in cross section, and a web projecting into the U-shaped recess. The U-shaped recess expediently opens in the closing direction of the lid. The U-shaped recess on the side walls of the case or of the lid is therefore formed U-shaped manner in a cross section parallel to a front wall of the case, and the U-shaped recess on a front wall or rear wall of the basic body or lid is formed in a U-shaped manner in the cross section parallel to a side wall of the case.

In a development of the invention, the U-shaped recess is provided on the lid and the web is provided on the sealing portion of the side walls of the basic body.

By the U-shaped recess being provided on the lid, dirt possibly contained in the U-shaped recess of the lid can already drop out of the U-shaped recess as the lid is being closed.

In a development of the invention, the base of the U-shaped recess is provided with an elastic seal.

By the elastic seal being arranged on the base of the U-shaped recess, the latter is readily protected both against insolation and also against mechanical damage. The durability of the seal can thereby be extended.

In a development of the invention, an inner surface of the side wall of the basic body, which inner surface faces the opening of the basic body which is closable with the lid, forms a continuation of the labyrinth seal with an outer surface of the side wall of the lid.

As a result, a continuation of the labyrinth seal and even better sealing can be achieved in the region of the side walls of the basic body, the upper edge of which is exposed in the closed state of the lid. In the closed state, the lid is connected on the front side and rear side thereof to the basic body in a comparatively stiff manner, firstly by means of a hinge and then by a lock of the case. In the region of the side walls, the rigidity of the lid holds the latter against the side walls of the basic body. The region of the lateral side walls is therefore generally critical with respect to sealing of the case. As a result, a continuation of the labyrinth seal by means of the side walls of basic body is extremely advantageous in order to provide a secure seal all the way around the case.

In a development of the invention, the inner surface of the side wall of the basic body and the outer surface of the side wall of the lid form boundaries of a groove which is open towards the front side and towards the rear side of the basic body.

Such a groove continues the labyrinth seal between the lid and the basic body.

In a development of the invention, the side wall of the basic body is provided on the outside with outlet holes in the region of the transition to the groove base of the groove formed with the outer surface of the side wall of the lid.

By means of such outlet holes, water which has possibly penetrated into the groove can rapidly flow away. The groove is expediently open towards the rear wall and towards front wall of the case. The provision of the additional outlet holes thus reliably prevents water from stopping in the groove.

Figure 2:
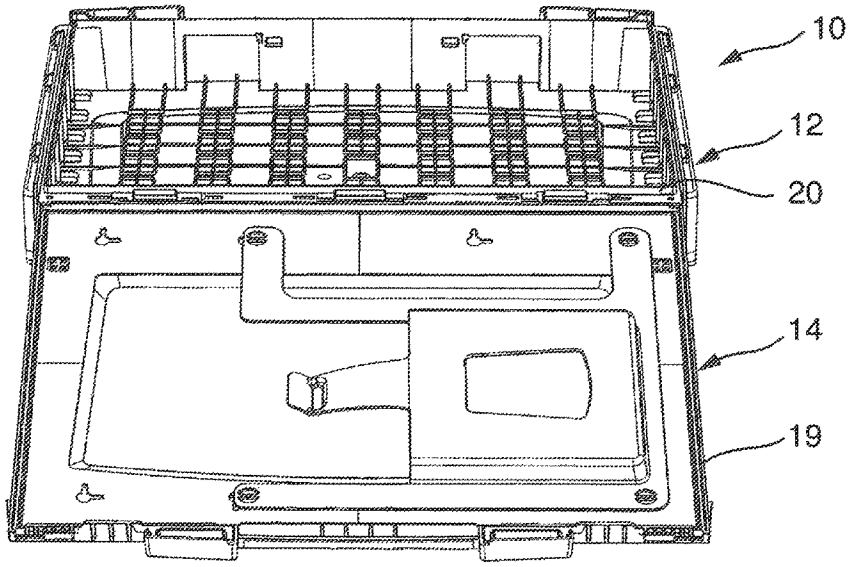
Figure 3:
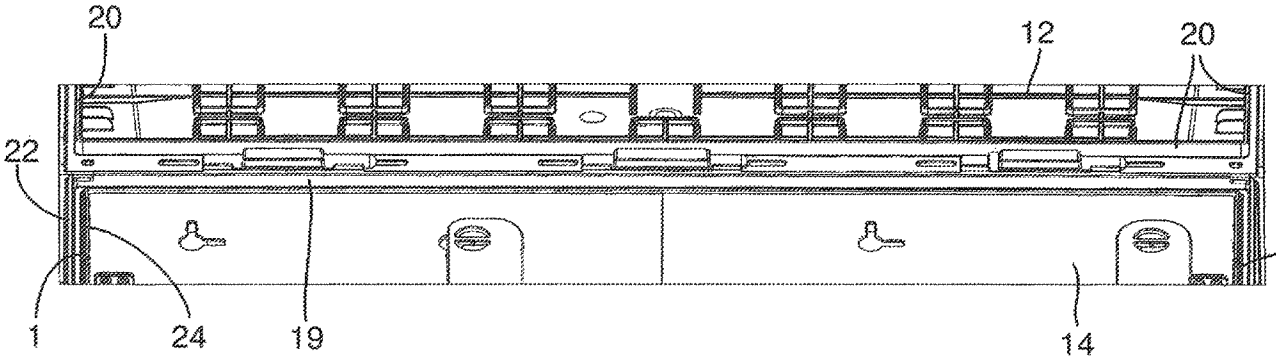
Figure 4:
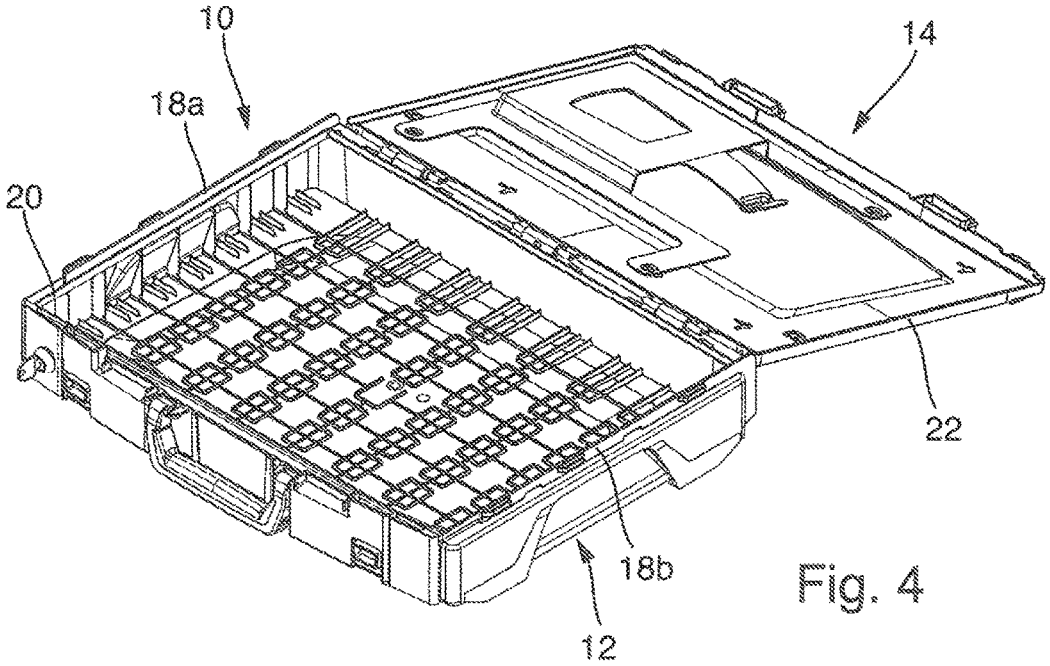
Figure 5:
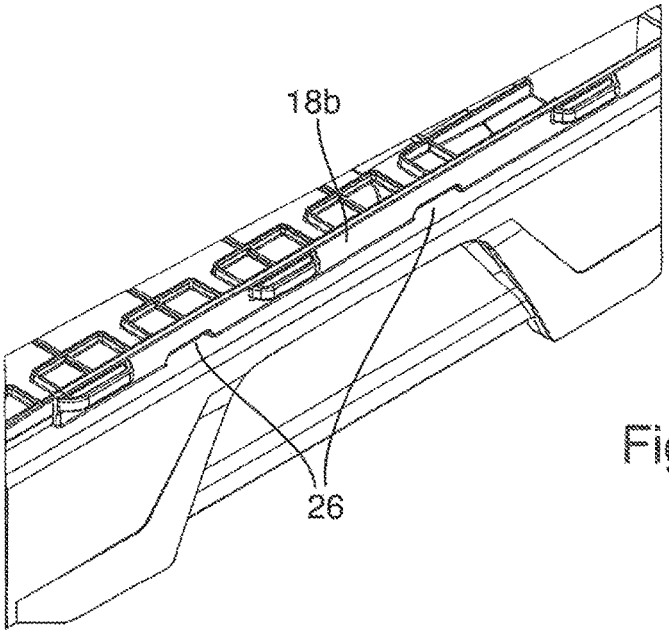
Figure 7:
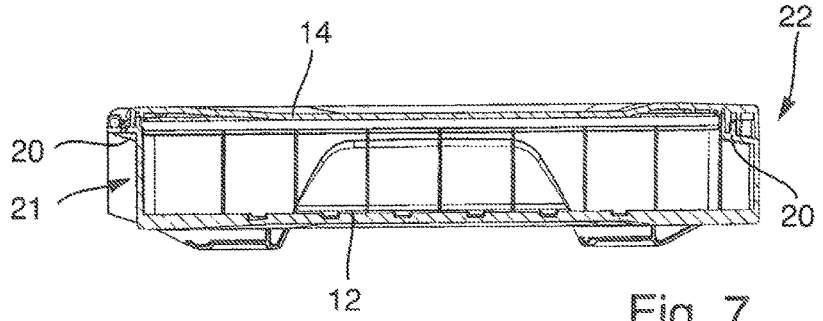
Figure 8:
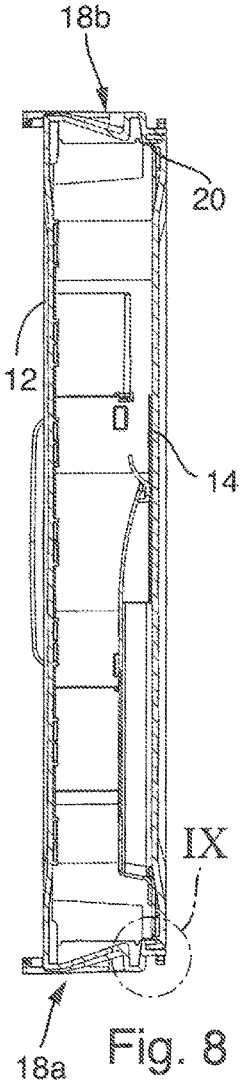
Figure 6:
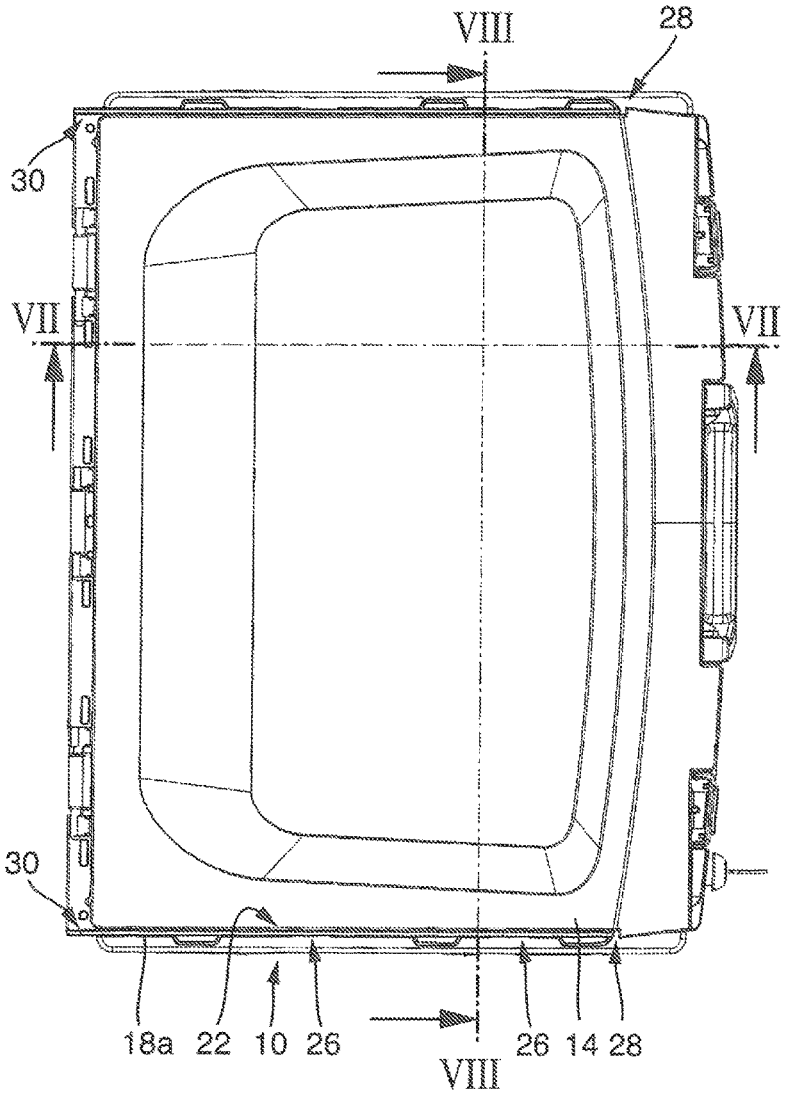
Figure 9:
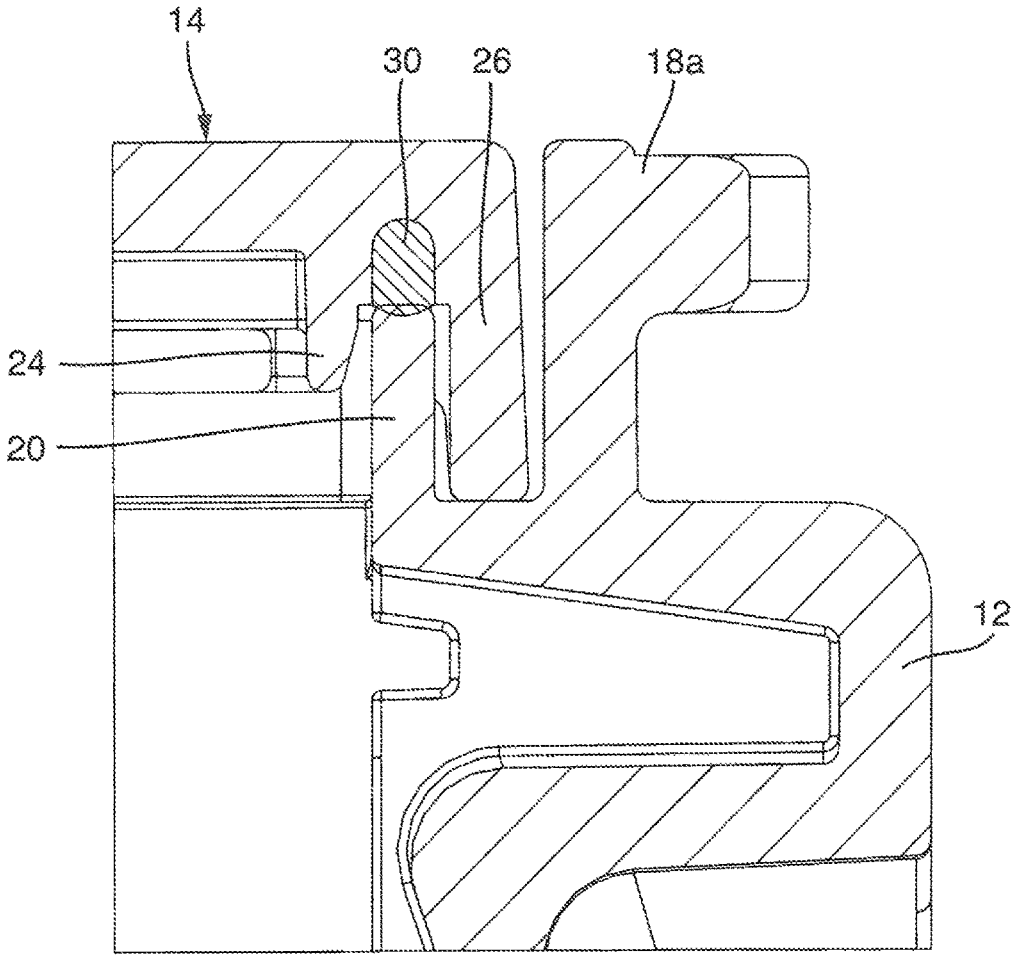

Further features and advantages of the invention emerge from the claims and the description below of a preferred embodiment of the invention in conjunction with the drawings. In the drawings:

FIG. 1 shows an illustration of a case according to the invention from the side in the closed state, FIG. 2 shows an illustration of the case from FIG. 1 with the lid completely open, FIG. 3 shows an enlarged detail of the case from FIG. 2, FIG. 4 shows a view of the completely open case from FIG. 2 from a different view angle obliquely from above, FIG. 5 shows an enlarged detail of the case from FIG. 4, FIG. 6 shows a view of the closed from FIG. 1 from above, FIG. 7 shows a view of the section plane VII-VII in FIG. 6, FIG. 8 shows a view of the section plane VIII-VIII in FIG. 6, FIG. 9 shows an enlarged illustration of the detail IX from FIG. 8.

FIG. 1 shows, in a lateral view obliquely from above, a case 10 according to the invention which has a basic body 12 and a lid 14 coupled pivotally to the basic body 12. A pivoting hinge 16 which connects the basic body 12 and the lid 14 is arranged on the right in FIG. 1. In the completely closed state illustrated in FIG. 1, the lid 14 is arranged within the side walls 18 of the basic body 12. In other words, this means that the respective upper edge of the side walls 18 of the basic body is exposed in the completely closed state of the lid 14. Such an inner arrangement of the lid 14 is advantageous, for example, if the case 10 is intended to be stackable. When a plurality of cases 10 are stacked, a lower edge of the side walls 18 of the case 10 engages in the upper edge of the side wall of a further case. By this means, the lid 14 is not subjected to a load even if numerous cases are stacked. Above all, a stack of a plurality of cases 10 can then be formed in a very stable manner since the stability of the stack is determined only by the basic body 12 of the plurality of cases, and not by the lids 14. Since the lid is also protected by the respective upper edges of the side walls 18, the lid 14 reliably keeps in the closed state even if the case 10, for example, drops down and lands in the region of the upper edge of a side wall 18 on the ground.

The illustration of FIG. 2 shows the case 10 from FIG. 1 with the lid 14 completely open. It can already be seen in the illustration of FIG. 2 that the outer edge of the lid 14 has an encircling U-shaped recess 19. Said U-shaped recess 19 can be seen in the completely open state of the lid 14; in the closed state of the lid 14, said recess accommodates a web 20 encircling the opening in the basic body 12. In the completely closed state of the lid 14, the U-shaped recess 19 and the web 20 engaging in the U-shaped recess 19 then form a labyrinth seal. Said encircling labyrinth seal reliably prevents dirt, moisture and water from penetrating the interior of the case 10.

The illustration of FIG. 3 shows an enlarged detail from FIG. 2, namely in the region of the pivotable coupling of the lid 14 to the basic body 12. The U-shaped recess 19 on the lid 14 can be seen in this enlarged illustration, the recess being formed between an encircling outer web 22 and a likewise encircling inner web 24. The encircling web 20 of the basic body 12 can likewise be seen.

The illustration of FIG. 4 shows the case 10 from FIG. 2 from a different viewing angle obliquely from above. The encircling web 20 of the basic body 12 can again be seen.

Furthermore, it can be gathered from FIG. 4 that the upper edge of the lateral side walls 18*a*, 18*b* of the basic body 12 together with the encircling web 20 in the region of the side walls 18*a*, 18*b* of the case in each case forms a groove which is open towards the front side and towards the rear side of the case. The outer encircling web 22 of the lid 14 is arranged in said groove. In the closed state of the lid 14, the outer surface of the web 22 therefore in each case forms a continuation of the labyrinth seal with the inner surface of the upper edge of the side walls 18*a*, 18*b*.

It can be gathered from the enlarged detail of FIG. 5 from FIG. 4 that the lateral side walls 18*a*, 18*b* are provided with outlet holes 26 which connect the base of the groove between the respective inner surfaces of the side walls 18 and the outer surfaces of the web 22 to the surroundings outside the case. Said groove can thereby be rapidly and reliably drained via the outlet holes 26.

The illustration of FIG. 6 shows the closed case 10 from FIG. 1 in a top view. It can readily be seen that the groove between the upper edge of the side walls 18 and the web 22, which forms the lateral boundary of the lid 14, is open towards the front side of the case and towards the rear side of the case, see points 28, 30. Water can flow out of said groove at said points 28, 30. The outlet openings 26 which likewise drain said groove are merely indicated in the illustration of FIG. 6.

The illustration of FIG. 7 shows a view of the section plane VII-VII in FIG. 6. It can be seen how the encircling web 20, which surrounds the opening in the basic body 12, engages in the U-shaped recess on the lid 14 and thereby realizes a labyrinth seal between the lid 14 and the basic body 12 in the region of a rear wall 21 and a front wall 23 of the case 10 in the closed state.

The illustration of FIG. 8 shows a view of the section plane VIII-VIII in FIG. 6. It can also be gathered from FIG. 8 how the web 20, which encircles the opening in the basic body 12, engages in the U-shaped recess on the lid 14 and thereby realizes a labyrinth seal in the region of the side walls 18*a*, 18*b* of the case 10.

The illustration of FIG. 9 shows the detail XI from FIG. 8 in an enlarged manner. The U-shaped groove, into which the web 20, which encircles the opening in the basic body 12, extends, is formed between the inner web 24 and the outer web 26 of the lid 14. At the base of said groove, a seal 30, on which the upper edge of the web 20 rests, is injected into the lid 14. In addition to the labyrinth seal, a further sealing effect is thereby achieved by means of the seal 30 and the upper edge of the web 20. Like the webs 24, 26, the seal 30 encircles the entire periphery of the lid 14. The seal 30 is protected within the U-shaped recess against insolation and mechanical damage.

It can furthermore be gathered from FIG. 9 that an outer surface, located on the right in FIG. 9, of the web 20 forms, with the upper edge of the side wall 18*a* of the basic body 12, a further U-shaped recess, into which the web 26 of the lid 14 extends. As has already been explained, the labyrinth seal is thereby continued between the web 20 and the lid 14. The case 10 is constructed in the same manner on the opposite side wall 18*b*, see FIG. 8.

It can furthermore be gathered from FIG. 9 that, in the illustrated completely closed state of the lid, a lower edge of the web 26 of the lid 14 bears against the base of the U-shaped groove between the web 20 and the upper edge of the side wall 18*a*. A completely closed position of the lid is thereby precisely defined and especially there need be no concern that the seal 30 is compressed too strongly and thereby loses the elasticity thereof over the course of time.

The invention claimed is:

1. Case for holding tools or small parts, comprising:

a basic body; and a lid coupled pivotably to the basic body, wherein the basic body has two side walls, the upper edge of which is exposed in the closed state of the lid, and therefore the lid, in the closed state, is arranged between the upper edges of the side walls of the basic body, and wherein each side wall of the basic body forms a labyrinth seal with the respective side wall of the lid in the closed state of the case, wherein at least one inner surface of the side wall of the basic body, which inner surface faces the opening in the basic body that is closable with the lid, forms a continuation of the labyrinth seal with an outer surface of the side wall of the lid.

2. Case according to claim 1, wherein a rear wall of the lid together with a rear wall of the basic body, and a front wall of the lid together with a front wall of the basic body, in each case form a labyrinth seal, and therefore the labyrinth seal encircles an opening in the basic body, which opening is closed by means of the lid.

3. Case according to claim 1, wherein the labyrinth seal is formed by means of a U shaped recess in the cross section of the case and a web projecting into the U shaped recess.

4. Case according to claim 3, wherein the U shaped recess is provided on the lid and the web is provided on the sealing portion of the side walls of the basic body.

5. Case according to claim 3, wherein the base of the U shaped recess is provided with an elastic seal.

6. Case according to claim 1, wherein the inner surface of the side wall of the basic body and the outer surface of the web on the basic body form boundaries of a groove which is open towards the front side and towards the rear side of the basic body.

7. Case according to claim 6, wherein the side walls of the basic body are provided with outlet holes in the region of the transition to the groove base of the groove formed with the outer surface of the web of the basic body.

* * * * *